United States Patent [19]

Chrones

[11] Patent Number: 4,545,378

[45] **Date of Patent: * Oct. 8, 1985**

[54] BABY PACIFIER

[75] Inventor: Anthony Chrones, Warwick, R.I.

[73] Assignee: Gerber Products Company, Fremont, Mich.

[ * ] Notice: The portion of the term of this patent subsequent to Jun. 8, 2001 has been disclaimed.

[21] Appl. No.: 19,460

[22] Filed: Mar. 12, 1979

[51] Int. Cl.[4] ..... A61J 17/00

[52] U.S. Cl. ..... 128/360; 128/359

[58] Field of Search ..... 128/359, 360, 252

[56] References Cited

U.S. PATENT DOCUMENTS

| | | | |
|---|---|---|---|
| 3,610,248 | 10/1971 | Davidson | 128/360 |
| 4,078,570 | 3/1978 | Frodrich et al. | 128/359 |
| 4,132,232 | 1/1979 | Lerner | 128/360 |
| 4,195,368 | 4/1980 | Duckstein | 128/360 |

FOREIGN PATENT DOCUMENTS

| | | | |
|---|---|---|---|
| 2401117 | 7/1974 | Fed. Rep. of Germany | 128/360 |
| 1315459 | 9/1956 | Switzerland | 128/360 |

*Primary Examiner*—Edward A. Miller
*Assistant Examiner*—T. J. Wallen
*Attorney, Agent, or Firm*—Townsend and Townsend

[57] ABSTRACT

A baby pacifier molded in two pieces and assembled into a permanently united unitary construction. The shield is constructed of a stiff plastic material and can have any peripheral contour. It can also be flat or bowed. The shield has a central opening in the form of either a flat elongated slot for the bowed type, or an annular opening for the annular shield. In either case, both sides of the opening are provided with flat, thickened, peripheral portions forming seats or shoulders. The nipple or baglet and the handle are molded in a single unitary integral construction open at the rear to prevent collapse of the baglet. Spaced from the rear end, the baglet shank is provided with integral spaced collars having flat parallel wall portions in spaced opposed relation. The handle is molded to the baglet shank at the rear end. In assembly, the baglet and collars are heated to soften the material, the baglet is then pulled through the opening from rear to front, and the front collar is pulled through the opening until the seats or shoulders around the opening become tightly wedged between the parallel walls of the two collars. This completely locks the two parts together so that the baglet is permanently locked to the shield.

1 Claim, 7 Drawing Figures

BABY PACIFIER

BACKGROUND OF THE INVENTION

Recently, safety regulations have required that baby pacifiers be subjected to various pull tests to ensure that the baglet will not separate from the shield and that the handle will not pull away. In response to these requirements various constructions have been devised, many requiring costly assembly operations. Attempts have been made to mold the various parts either separately or in a single one-piece construction.

SUMMARY OF THE INVENTION

The present invention provides a simple two-piece unit which requires a minimum assembly and results in a firm finished unit. The shield is constructed of a stiff plastic material in any desired contour. The shield is provided with a central opening having a flat thick peripheral portion on each side forming seats or shoulders. The nipple or baglet and the handle are molded of a soft material in a single unitary construction. Spaced from the rear end, the baglet shank is provided with two integral spaced collars having flat parallel wall portions in spaced opposed relation. The handle is molded to the baglet shank adjacent the rear end. In assembly, the baglet unit is heated to soften the material, and the baglet is pulled through the shield opening, rear to front. The front collar is also pulled through until the seats or shoulders about the opening become tightly wedged between the parallel walls of the collars. In this position, the parts are permanently locked to each other, and the baglet cannot pull away from the shield, and the handle is permanently molded to the baglet shank.

DESCRIPTION OF THE INVENTION

Figure 1:
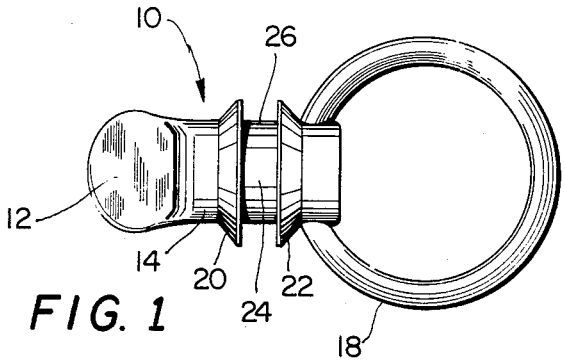
FIG. 1 is a top plan view of the unitary baglet and handle of the present invention.
Figure 2:
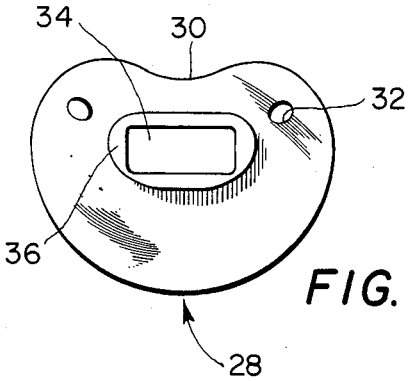
FIG. 2 is a front view of the shield.

Referring more in detail to the drawings, the pacifier of the present invention is made in two pieces molded separately, the baglet and handle shown in FIG. 1 and the shield shown in FIG. 2. The baglet unit 10 is illustrated in an oval flattened form. The baglet 12 at the front end is formed in accordance with the NUK nipple, U.S. Pat. No. 2,520,773. Extending integrally rearwardly from the baglet 12 is an elongated flattened oval hollow shank 14 which terminates in the open rear end 16, to allow the air to enter the baglet 12 and prevent collapse.

Adjacent the rear end, the shank 14 is provided with the integral annular handle 18 which is molded integrally with the unit 10. Intermediate the handle 18 and the baglet 12, the shank 14 is provided with integral spaced collars 20 and 22. The forward collar 20 is bevelled at the front, FIG. 1, and is provided with a vertical rear shoulder extending at right angles from the shank body 14. The rear collar 22 is spaced along the shank at 24 is bevelled at the rear and is provided with a vertical front shoulder extending at right angles from the shank 14. The front and rear shoulders are in spaced parallel relation, FIG. 1, forming a space 26 therebetween.

Now, referring to FIG. 2, the shield 28 is of the bowed type with a rounded and curved perimeter 30. The shield 28 should be provided with a plurality of relief openings 32 as required by the safety regulations. The shield is provided with an elongated rectangular opening 34. On each side of the shield, front and rear, the opening 34 is provided with a thickened perimeter portion 36 forming a flat section on each side of the shield.

Figure 3:
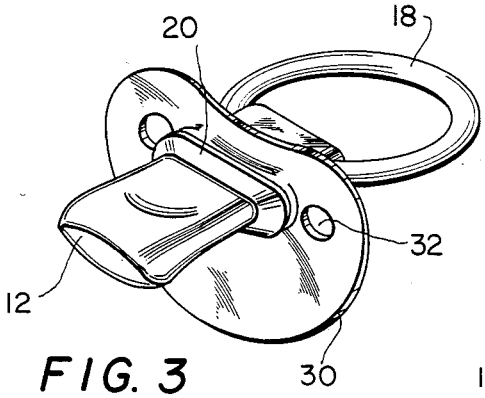
FIG. 3 is a perspective view showing the front of the pacifier of the present invention.
Figure 4:
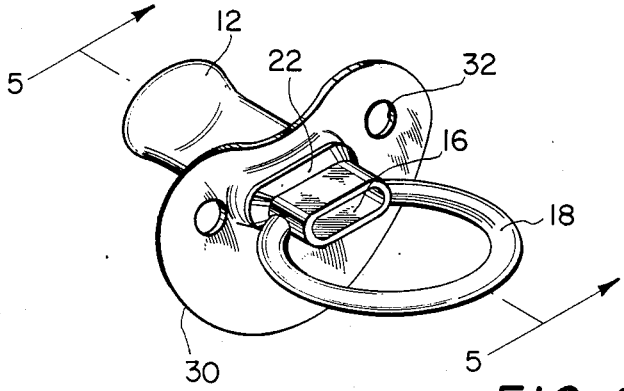
FIG. 4 is a perspective view showing the rear of the pacifier of the present invention
Figure 5:
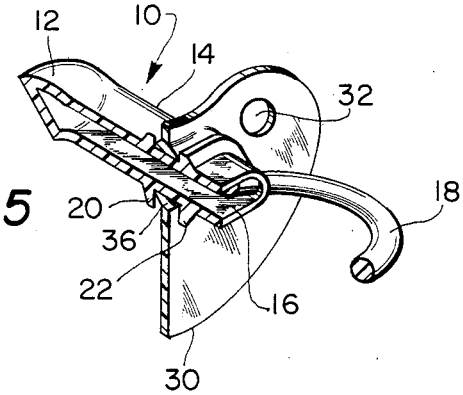
FIG. 5 is a section taken on line 5—5 on FIG. 4.

Now referring to FIGS. 3, 4 and 5, the pacifier is assembled by heating the unit 10 to soften it and pulling the baglet 12 through the opening 34, rear to front, until the front collar 20 passes through the opening. In this position the shield 28 will fit tightly between the vertical walls of the collars, see FIG. 5, the walls holding the baglet in position and locking the parts together. It will be found that the completed pacifier will withstand all pull tests, and the handle, being integral, will also pass the tests.

Figure 6:
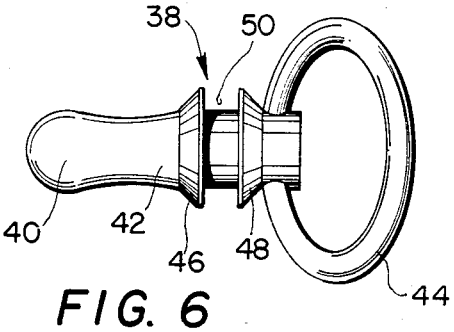
FIG. 6 is a view similar to FIG. 1 showing an annular form of the present invention.
Figure 7:
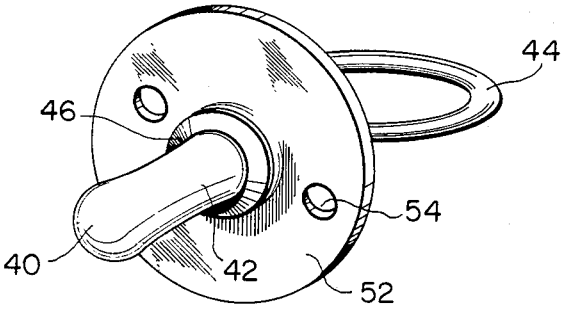
FIG. 7 is a perspective view of a pacifier using the form shown in FIG. 6.

FIGS. 6 and 7 illustrate the basic invention applied to an annular type of pacifier. As shown in FIG. 6, the baglet unit 38 comprises a conventional annular nipple 40 having an integral annular shank 42 and an open rear end. The handle 44 here is oval and integrally molded to the shank 42 adjacent the rear end.

Intermediate the ends, the shank 42 is provided with a pair of collars 46 and 48 identical to the collars 20 and 22 in the form shown in FIG. 1. The collars 46 and 48 form opposed parallel vertical walls which form the space 50 therebetween.

The shield 52 in this form is flat and annular. The shield is provided with the safety relief openings 54. The shield has an annular central opening. The nipple 40 is pulled through from the rear, after softening, until the shield nests tightly between the collars, see FIG. 7.

In both forms, the molding of the parts and the assembly are simple and easy. The finished pacifier is strong and will pass all the required tests. Other advantages of the present invention will be readily apparent to a person skilled in the art.

I claim:

1. In a baby pacifier, the combination of:

a soft, resilient, one-piece hollow shank having two ends, one of said ends forming a hollow baglet, the other of said ends extending into a handle, and between said ends having a symmetrical pair of spaced collars the mutually facing sides of which are perpendicular to said shank and define an annular locking groove, the non-facing sides of which are tapered down to said shank; and a rigid planar shield having an opening surrounded on both sides by flat thickened areas to form an annular tongue complementary to said groove whereby forcing the portion of said shank comprising said baglet and one of said collars through said opening locks said tongue in said groove.

* * * * *